US007195562B2

(12) United States Patent
Soderberg

(10) Patent No.: US 7,195,562 B2
(45) Date of Patent: Mar. 27, 2007

(54) KNOCKDOWN SKATEBOARD PARK SYSTEM

(76) Inventor: Mark S Soderberg, 1364 Placid Dr., Evergreen, CO (US) 80439

( * ) Notice: Subject to any disclaimer, the term of this patent is extended or adjusted under 35 U.S.C. 154(b) by 448 days.

(21) Appl. No.: 10/176,769

(22) Filed: Jun. 21, 2002

(65) Prior Publication Data

US 2003/0027644 A1 Feb. 6, 2003

Related U.S. Application Data

(60) Provisional application No. 60/300,375, filed on Jun. 21, 2001.

(51) Int. Cl.
*A63C 19/00* (2006.01)
*A63G 21/00* (2006.01)

(52) U.S. Cl. ..... 472/89; 472/92

(58) Field of Classification Search ..... 472/88, 472/89, 90, 92; 14/69.5
See application file for complete search history.

(56) References Cited

U.S. PATENT DOCUMENTS

| | | | | | |
|---|---|---|---|---|---|
| 3,406,617 | A * | 10/1968 | Randazzo | 472/90 |
| 5,165,690 | A * | 11/1992 | Kelley, Jr. | 473/184 |
| 5,341,533 | A * | 8/1994 | Seitz | 14/69.5 |
| 5,446,937 | A * | 9/1995 | Haskins | 14/69.5 |
| 5,524,310 | A * | 6/1996 | Farnen | 14/69.5 |
| 5,599,235 | A * | 2/1997 | Lynberg | 472/89 |
| 5,718,412 | A * | 2/1998 | Levanas | 256/1 |
| 6,042,480 | A * | 3/2000 | Labelson | 472/89 |
| 2002/0050589 | A1 * | 5/2002 | Nestel | 256/67 |

* cited by examiner

*Primary Examiner*—Kien Nguyen
(74) *Attorney, Agent, or Firm*—patenttm.us; James H. Walters

(57) ABSTRACT

A skate park system comprises interlocking pieces enabling quick assembly and disassembly. The disassembled pieces can lay flat, enabling storage in minimal space. Ramp, funbox and grindrail portions may be used separately or combined in varying manners to provide a variety of configurations.

18 Claims, 12 Drawing Sheets

KNOCKDOWN SKATEBOARD PARK SYSTEM

BACKGROUND OF THE INVENTION

This invention relates to skates, bikes and skateboarding, and more particularly to a knockdown skateboard park-like ramp system.

Skateboarders, bikers and skaters enjoy performing jumps and stunts. To that end, many communities are building skateboard parks, with formed ramps, bowls and jumps. However, children learning to do skate, skateboard or bike riding, or those trying to improve their skills, either are intimidated at the skate park by other more skilled children, or don't have access to a park.

To overcome this, some have built home ramps or jumps. However, these home-built ramps are bulky, and consume a large amount of space when not in use, in a garage, for example. Parents often are unhappy with or have to deal with huge, unsightly structures in the yard or garage. Typically these structures are screwed together wooden assemblies which are very heavy, cannot be easily transported, are unsightly, aren't weatherproof, somewhat dangerous due to splinters/loose screws, and can't be easily stored in a home environment.

SUMMARY OF THE INVENTION

In accordance with the invention, a knockdown system is provided wherein a skate, bike or skateboard, ramp is easily assembled for use, in different configurations, but quickly breaks down without tools and stores nearly flat.

Accordingly, it is an object of the present invention to provide an improved skateboard park system that stores flat.

It is a further object of the present invention to provide an improved skateboard park system that is easily assembled.

It is yet another object of the present invention to provide an improved skateboard park system comprising a "funbox", grind rail, and ramps.

It is yet another object of the present invention to provide an improved skateboard park system that is easily assembled to build quarter pipes, more elaborate rails, pyramids, etc.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The system according to a preferred embodiment of the present invention comprises a knock down "funbox", ramp and grindrail system, wherein the components are combinable in various combination to make skate/bike/skateboard park structures.

The system is comprised of various laser cut steel parts that interlock without tools to form various pieces of equipment to skateboard on. Although this system could be used at skate parks, skateboard shops, a mall, exhibitions, its primary target is for driveway and backyard use at home. The advantage is that kids learning or kids trying to get better, either are intimidated at the skate park by other kids, or don't have access to a park. A major advantage for "at home" use, is that the system quickly breaks down without tools and stores flat so parents don't have to deal with huge, unsightly structures in the yard or garage.

The system can also be used for those that in-line skate or use stunt bikes on skate park like obstacles. The pieces can be assembled into various components of a skate park system, including a "funbox", grind rail, and ramps. The same concept can be used to build virtually anything kids could want-quarter pipes, more elaborate rails, pyramids, etc.

Figure 1:
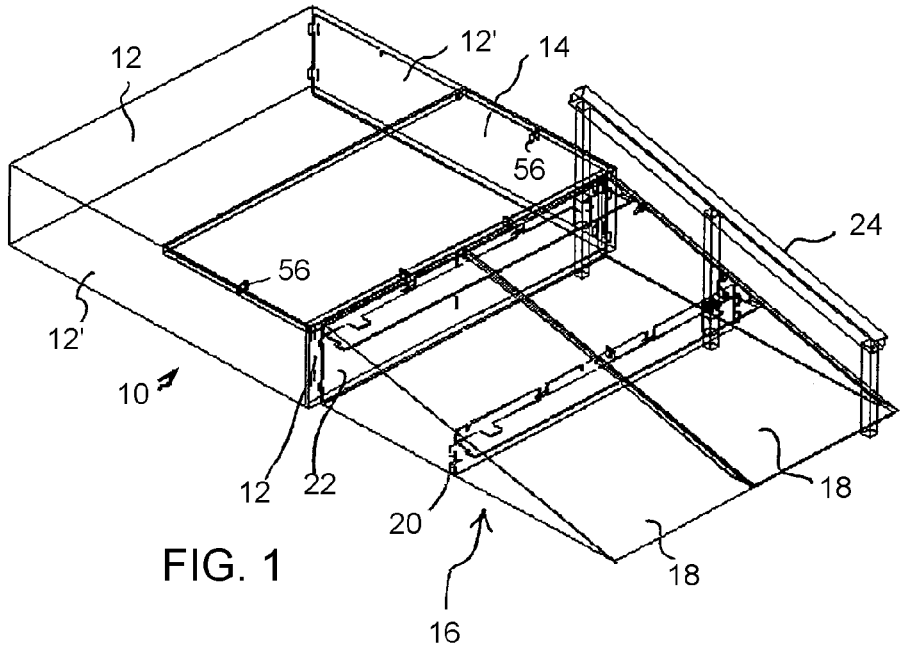
FIG. 1 is a perspective wire frame view of an embodiment of the invention in an assembled form.
Figure 17:
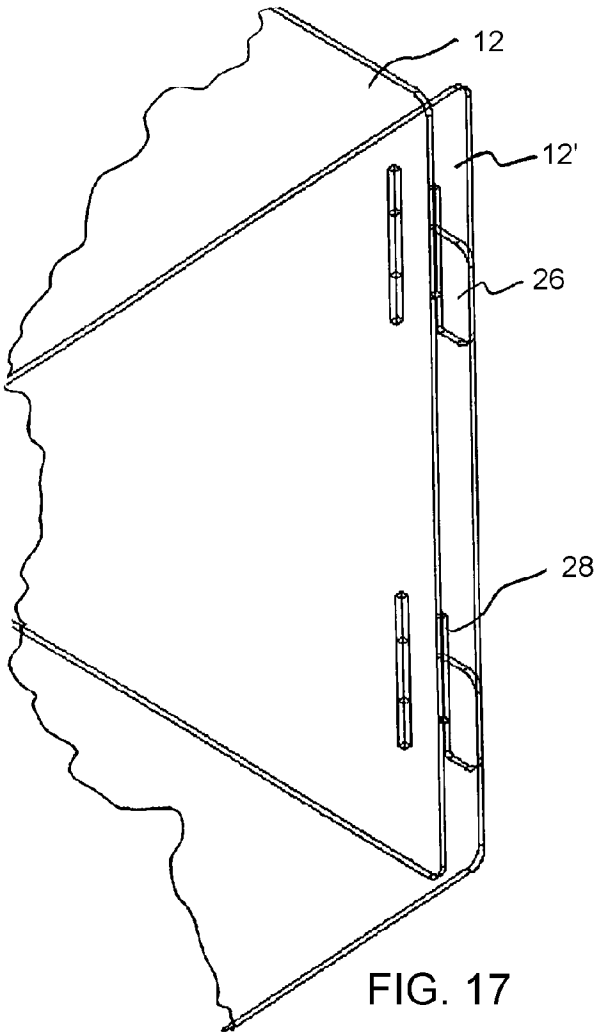
FIG. 17 is a wire frame view of a corner connection, illustrating the fastening thereof.

Referring now to FIG. 1, a perspective wire frame view of an embodiment of the invention in an assembled form, the system includes a fun box 10, which is assembled from four side portions, two side portions 12 and two side portions 12' and two interlocking top portions 14, only one top portion being present in the illustration of FIG. 1 and a cross brace is not shown. A ramp 16 comprises two top portions 18, two side pieces 36, an intermediate support 20 and an end support 22. A grindrail 24 is received in square cross section openings that are provided in the ramp or funbox. Covers may suitably be provided to cover the openings when not using the grindrail. The grindrail openings may be provided at any side of the ramp or funbox, so that left and right hand positioning may be accomplished, for example. The side and top portions and intermediate portions cooperatively mate as shown in the figures herein for a secure stable assembled structure. The side pieces use hook and slot engagement for assembly. FIG. 17 illustrates that the sides of the funbox include chamfered slots therein, and the top portions include mating clips that have corresponding chamfered mating slots, so that on assembly the top and sides will self align and square.

Figure 2:
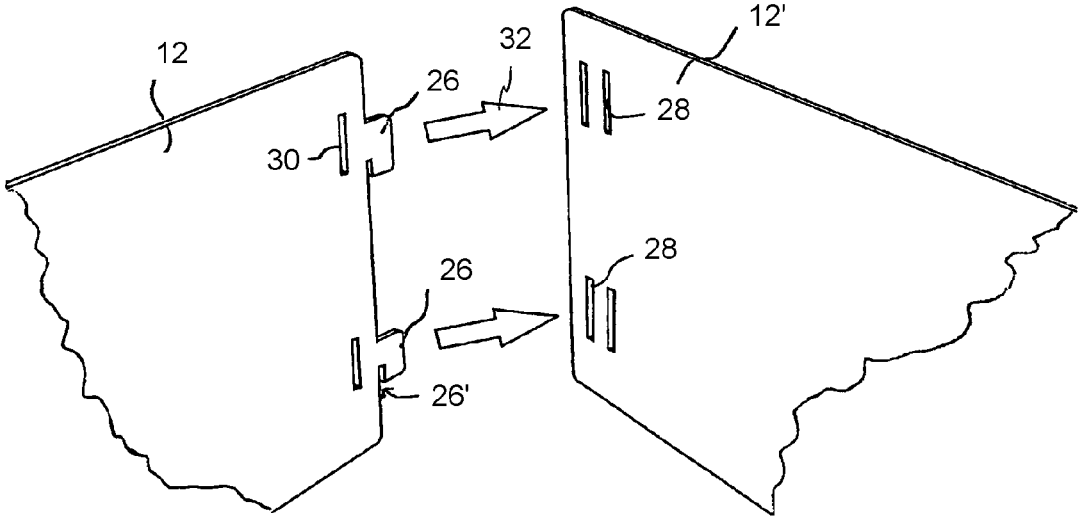
FIG. 2 is a perspective view of a close up of the attachment hook.

Referring now to FIG. 2, a perspective view of a close up of the attachment hook system according to the invention, the illustrated corner of the fun box 10 of FIG. 1 comprises a first side portion 12, which has first and second hook members 26 protruding outwardly therefrom. The hooks are co-planar with the rest of the side 12, being formed from the same sheet of material as the rest of the side 12. A second side portion 12' has defined therein two sets of corresponding mating slots 28, which are adapted to receive respective hook members 26 therein. The opening 26' at the bottom of the hook members interacts with the bottom of the slots 28, to engage the two side portions together. The first and second sets of slots 28 are spaced laterally apart. Note also that side portion 12 has a set of upper and lower slot members 30 defined therein.

Figure 3:
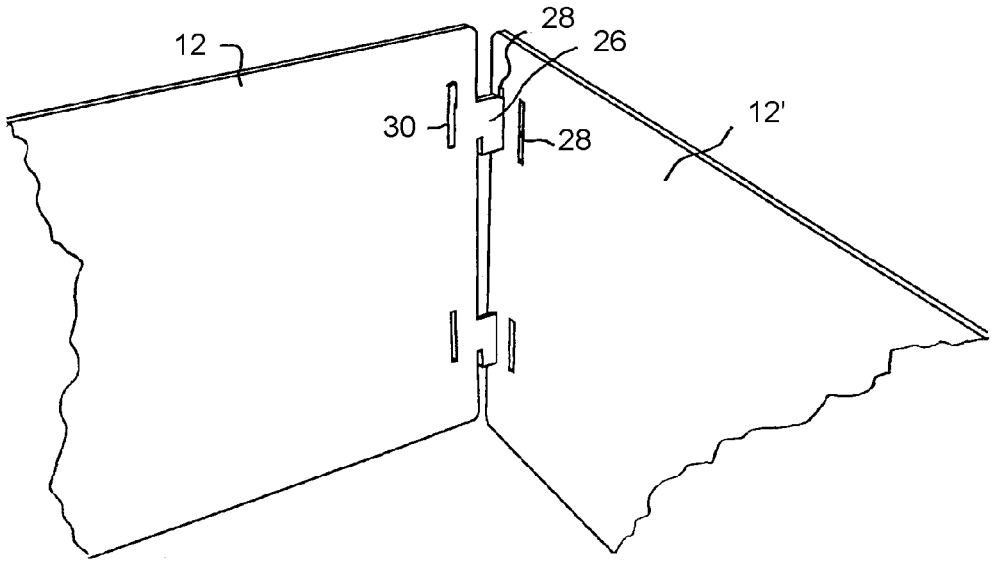
FIG. 3 is a perspective view illustrating insertion of the hook into the slot.
Figure 4:
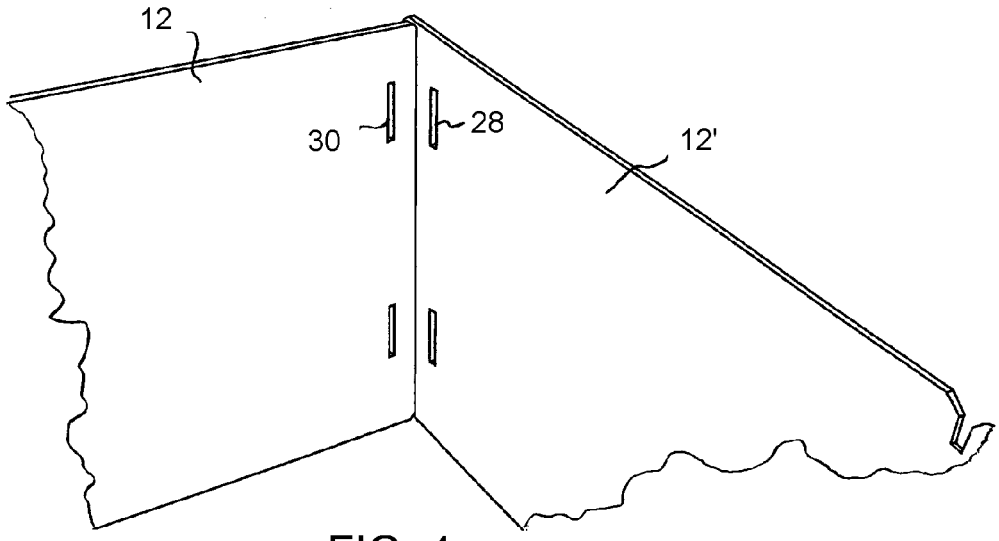
FIG. 4 is a perspective view as in FIG. 3 with the hook fully engaged into the slot.

When assembling the fun box, the side 12 is moved in the direction of arrows 32 of FIG. 2, so as to bring the hook members 26 into engagement with one of the sets of slots 28. As shown in FIG. 3, to assemble, one just inserts the hook into the slot. FIG. 4 illustrates the hook is fully engaged into the slot.

Figure 5:
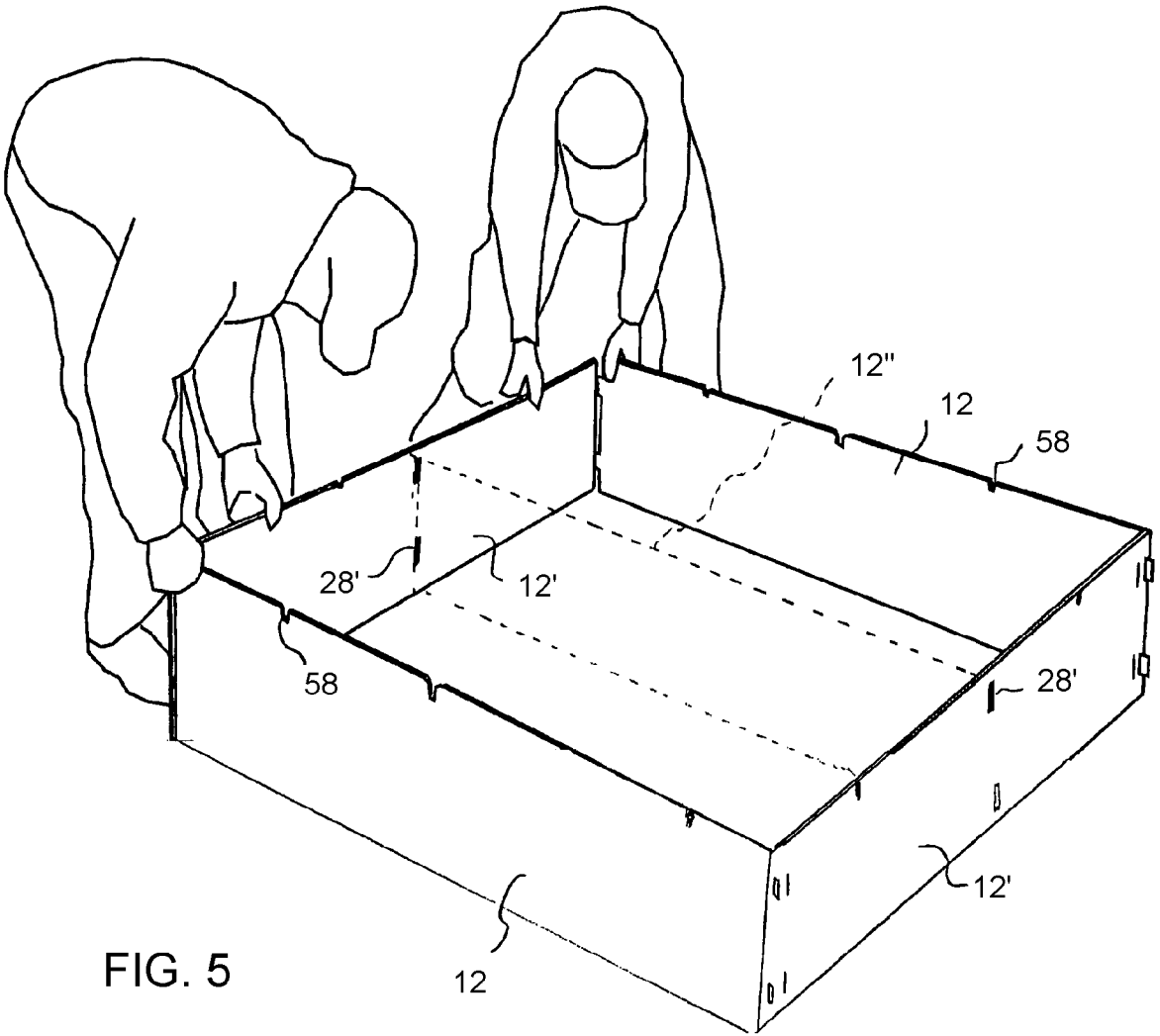
FIG. 5 is a view illustrating building up the "funbox", wherein the particular configuration is 4 sides and one center brace, with the center brace not yet installed.

Referring now to FIG. 5, a perspective view of building up the "funbox", the particular configuration illustrated comprises four sides (two sides 12, and two sides 12'). In the illustration of FIG. 5, two persons are connecting the last set of sides 12 and 12'. A center brace portion 12", illustrated in phantom in FIG. 5, may also be installed, corresponding to the configuration of sides 12, having hook members 26' on each end thereof. Corresponding slots 28' are provided in the middle portion of sides 12', to receive the center brace hooks.

Figure 6:
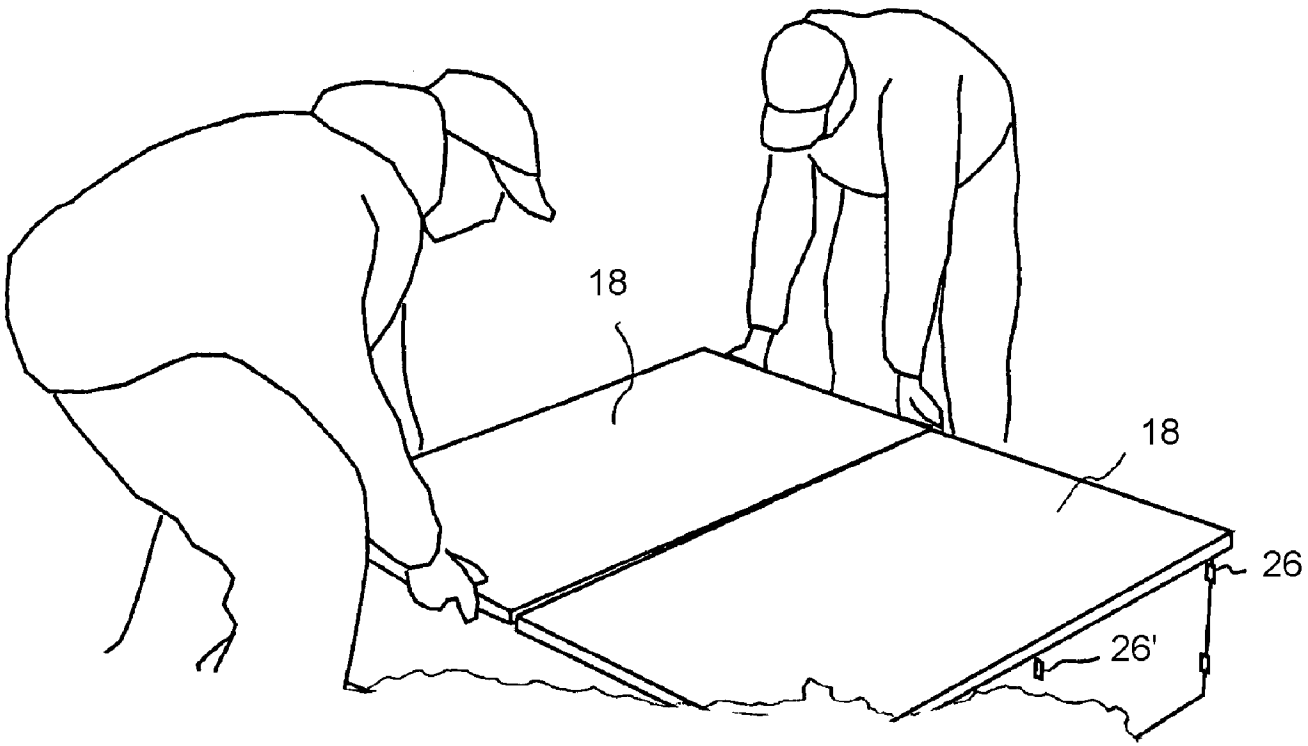
FIG. 6 is a view showing that the top of the "funbox" is two panels in the illustrated embodiment wherein the top pieces interlock slots in the box to make it rigid and to hold it square and wherein ramps may be plugged into any side of the box.

Referring now to FIG. 6, a view showing installation of top portions 18 of the "funbox", it may be observed that the top comprises two panels 18 in the illustrated embodiment wherein the top panels 18 interlock slots in the box to make it rigid and to hold it square and wherein ramps may be plugged into any side of the box. One reason for having the top of the "funbox" as two panels is that two pieces keep the weight reasonable for children to manage. The edges of the top are turned down for safety and to give them the right radius to "grind" along with a skateboard. The top pieces interlock with slots in the box to make it rigid and to hold it square, as discussed herein in connection with FIGS. 18 and 19 hereinbelow.

Figure 7:
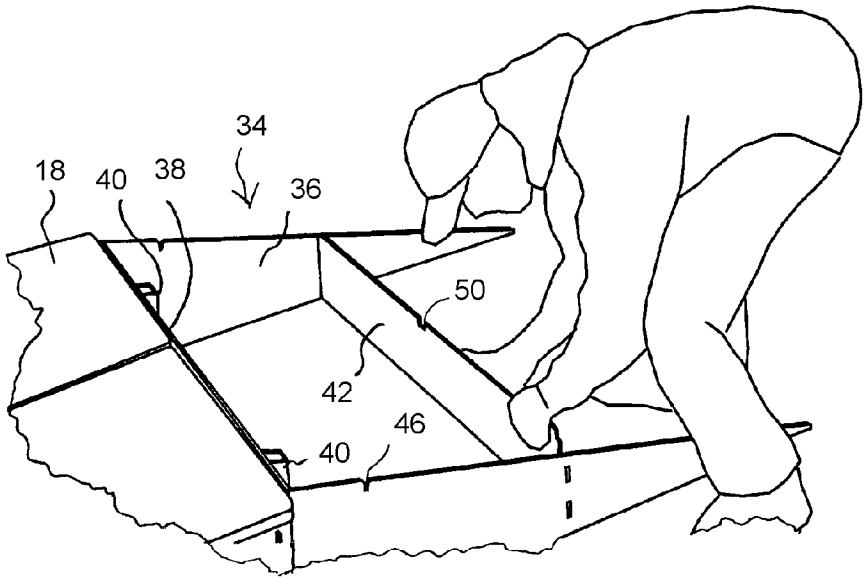
FIG. 7 is a view showing a ramp is being attached to the box.

FIG. 7 is a view showing a ramp being attached to the box. Ramp 34 comprises left and right sloped side members 36, upper cross member 38, which has left and right upper grind rail receivers 40 positioned near the outer ends thereof, and a central cross member 42. Central cross member 42 may also carry a corresponding grind rail receiver 40', visible in FIG. 11. In the view of FIG. 7, the skateboarder is just finishing installing the central cross member, which attaches to the sides 36 by use of hook members defined in the cross member that correspond to hooks 26, and receiving slots in the side member 36 that correspond in structure and function to slots 28 or 30 of the sides 12', 12 (FIG. 2). Ramps may be plugged into any side of the box, by engagement with one of the extra sets of slots 28 or slots 30 of the sides 12' or 12 by hook members 44 defined at the upper end of the ramp side, visible in FIG. 10. Also, a notch 46 is defined in the sides 36, at a position part way between the upper end of the ramp and the portion of the ramp where the central cross member 42 is located.

Figure 8:
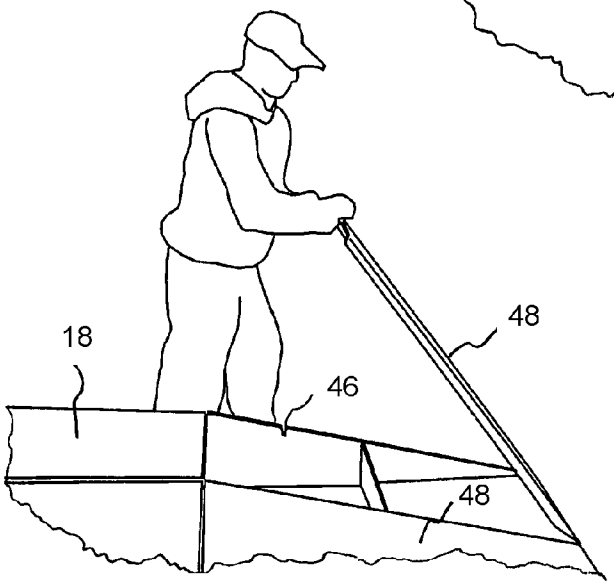
FIG. 8 is a view showing the two ramp top pieces being laid in place and that they interlock into corresponding slots.

Referring now to FIG. 8, a view showing installing of the top of the ramp, two ramp top pieces 48 are provided and are installed by being laid in place over the ramp sides and cross members. One of the ramp pieces is installed in the foreground of FIG. 8, and the second is in the process of being installed. Tabs (not visible in FIG. 8) corresponding to notches 46 are provided on the lower sides of the ramp top, whereby engagement of the tabs and slots 46 results in interlocking engagement.

Figure 9:
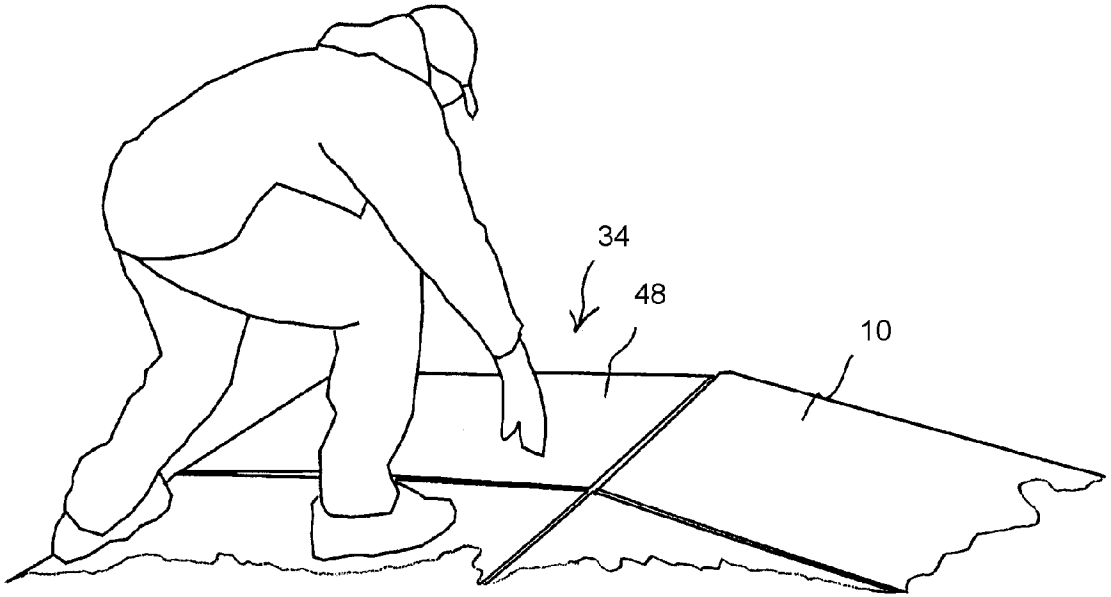
FIG. 9 is a view showing a ramp attached to a "funbox"

FIG. 9 is a perspective view of the ramp assembled and attached to the fun box. A skateboarder is standing on the ramp in this view, having just finished installing the ramp top in place.

Figure 10:
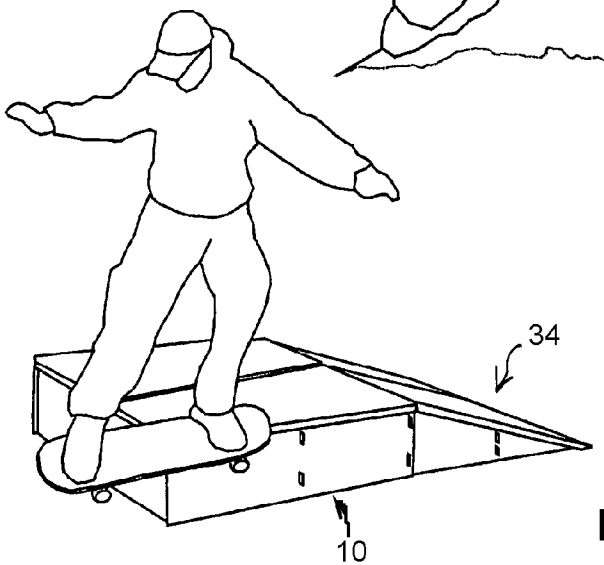
FIG. 10 is a view showing a skateboarder using a box with one ramp.

FIG. 10 illustrates a skateboarder using the assembled funbox 10 with one ramp 34 attached. The funbox can be used by itself, or in this case, as a box with one ramp.

Figure 11:
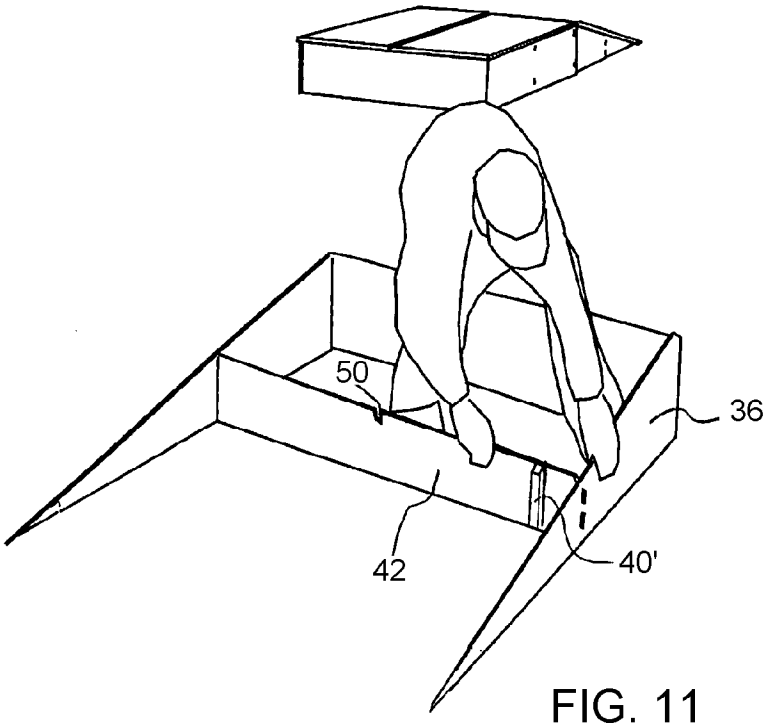
FIG. 11 is a view illustrating building up a ramp to use by itself, wherein a ramp with "funbox" is visible in the background.

Referring now to FIG. 11, a view illustrating building up a ramp to use by itself, a previously assembled ramp with "funbox" is visible in the background. A grind rail receiver 40' is visible on the right side of the central cross member in this view. A corresponding receiver may suitably be provided at the left side, also. At the center of central cross member 42, a notch 50 is provided, to receive portions of the top 48 therein, for stable engagement thereof.

Figure 12:
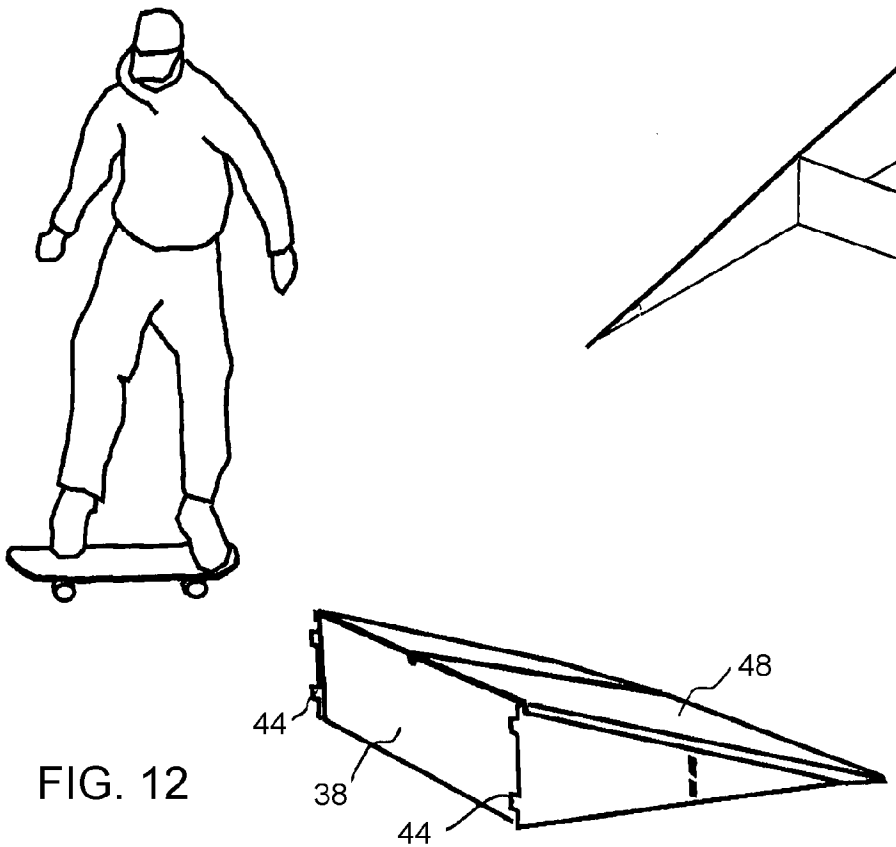
FIG. 12 is a view showing using the ramp by itself as a "launch ramp"

FIG. 12 is a view showing using the ramp by itself as a "launch ramp", wherein the skateboarder is airborne after leaving the ramp. The end hook members 44 of the ramp sides are visible in FIG. 12, and by inserting these hook member 44 in to the slots 28 or 30 of the fun box, the ramp may be securely attached to the box.

Figure 13:
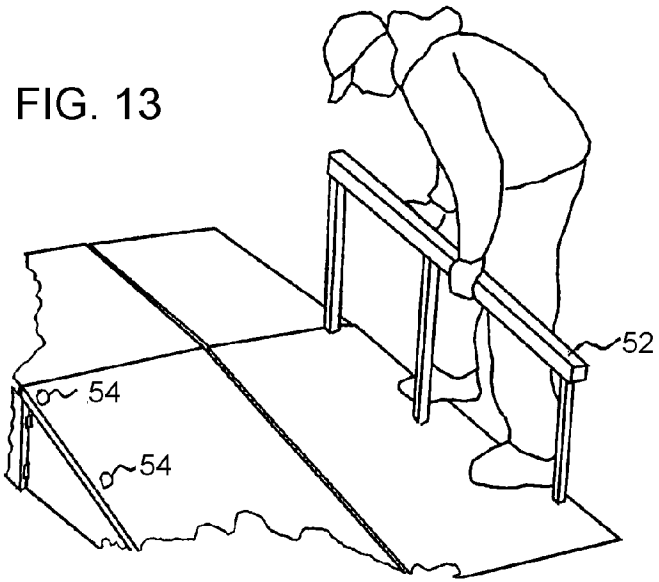
FIG. 13 is a view showing attachment of a "grind rail" to the fun box.

As noted before, the ramps have square tube sockets 40, 40' defined in the upper and central cross members, to receive a "grind rail". FIG. 13 is a view showing attachment of a "grind rail" 52 to the fun box. The grind rail is an elongate bar, with 3 downwardly extending legs substantially evenly spaced therealong. The legs differ in length from shorter on one end to longer on the other end of the bar, such that when the grind rail is installed, it is at an angle with respect to the ground. This angle can match the angle of the ramp, or can be different from the angle of the ramp, or can even be substantially parallel to the ground, for example. Grind rails can be inserted to either side of the ramp. Visible in FIG. 13 are grind rail receiving hole plugs 54, which may be used to cover the grind rail receiving holes in the ramp top portions, when the grind rail is not used.

Figure 14:
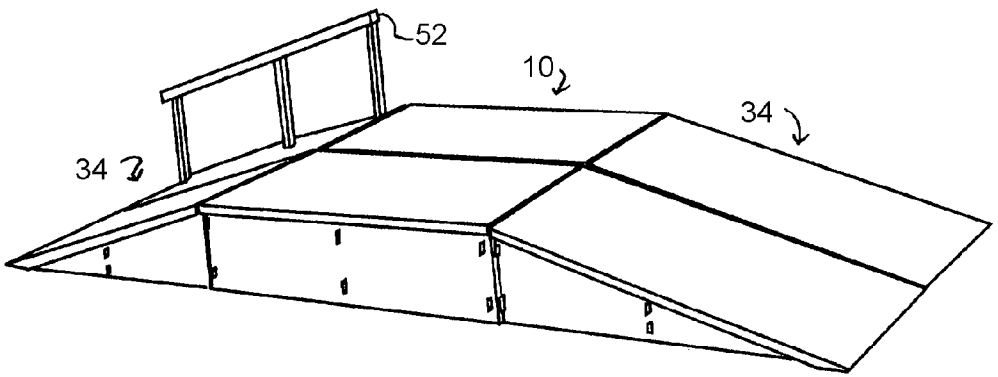
FIG. 14 is a perspective view of two ramps attached to a "funbox" with a "grind rail"

Many different configurations are possible with the system of the invention. For example, FIG. 14 is a perspective view of two ramps attached to a "funbox" with a "grind rail" installed.

Figure 15:
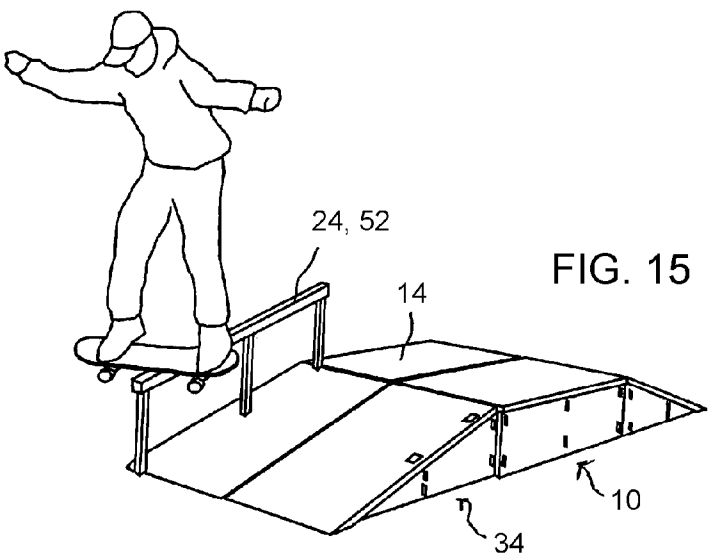
FIG. 15 is a view of a skateboarder "board sliding" the "grind rail" as an example of one of the uses of the invention.

FIG. 15 is a view of a skateboarder "board sliding" the "grind rail" as an example of one of the uses of the ramp system.

Figure 16:
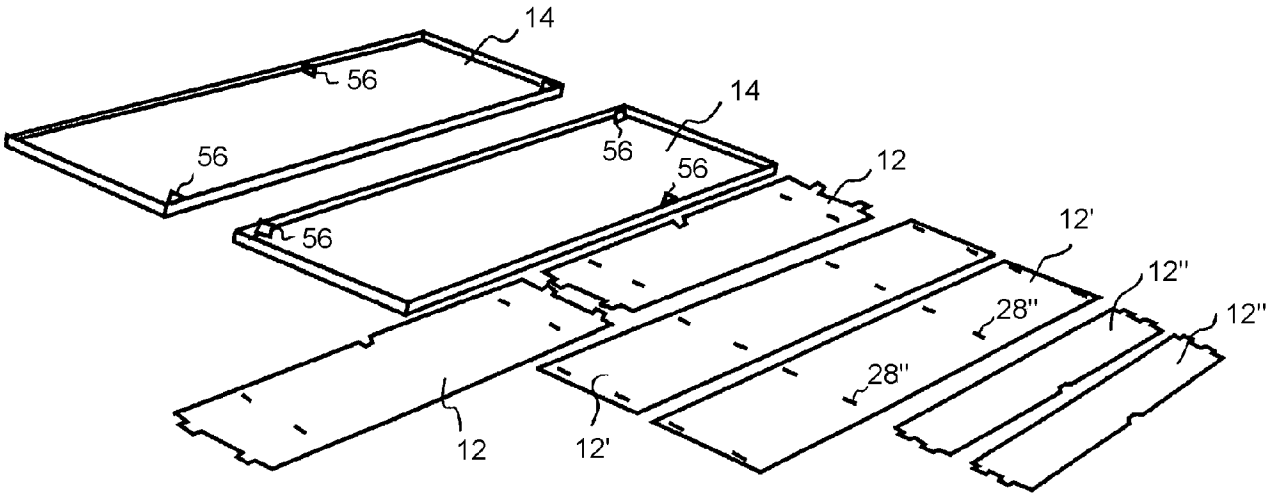
FIG. 16 is a view illustrating the essentially flat configuration of a fun box when disassembled.

A major advantage for "at home" use, is that the system quickly breaks down without tools and stores flat so parents don't have to deal with huge, unsightly structures in the yard or garage. FIG. 16 is a view illustrating the essentially flat configuration of a fun box when disassembled, with the sides 12, 12', top pieces 14, and two brace portions 12". In the configuration shown in FIG. 16, two braces 12" may be used, spaced on either side of the center of the box, rather than a single brace portion as in the. Corresponding slots 28" are provided in the sides to engage with the hooks of the cross members.

FIG. 17 is a wire frame perspective view of a corner connection, illustrating the fastening of hook members of side 12 into the corresponding slots 28 of side 12'. Dual "hook and slot" fastening provides vertical stability and allows assembly and rigidity even on somewhat non-flat surfaces.

Figure 18:
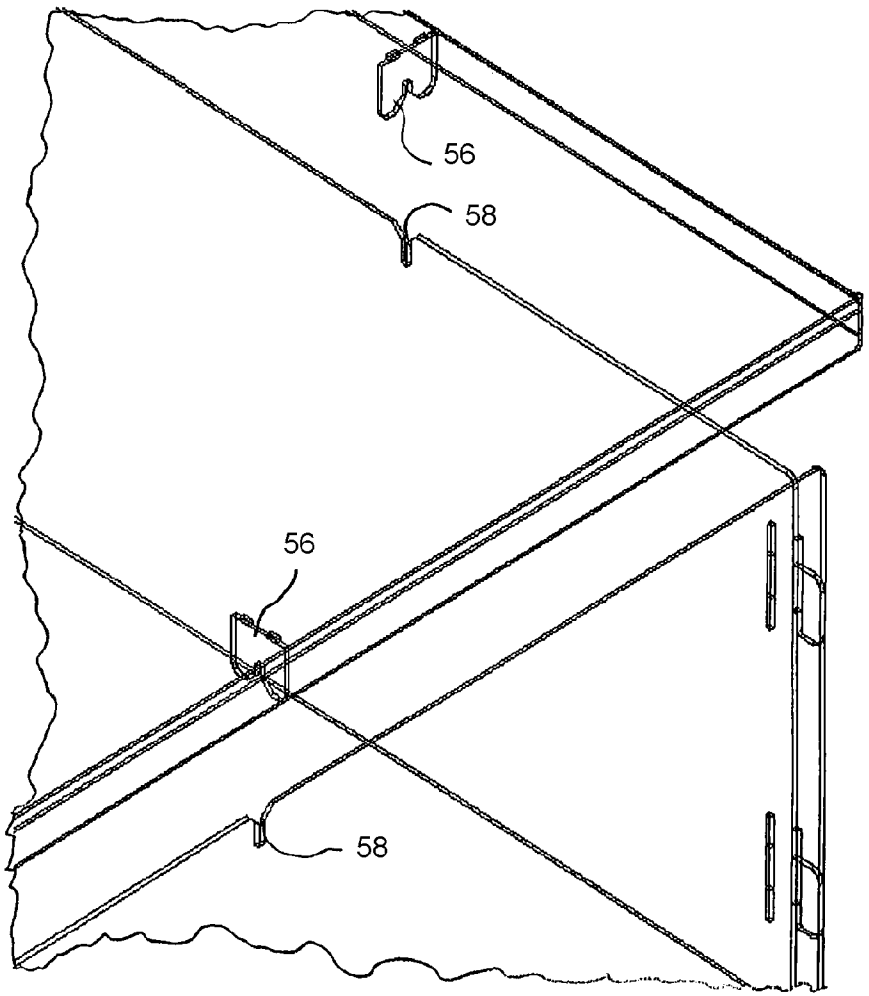
FIG. 18 is a wire frame view that illustrates dual "hook and slot" fastening to provide vertical stability and allows assembly and rigidity even on somewhat non-flat surfaces and also illustrates alignment tabs on top surface and corresponding slots on verticals panels having significant lead-in to "self-align" upon assembly.

Referring now to FIG. 18, a wire frame view that illustrates alignment tabs 56 on top surfaces and corresponding slots 58 on verticals panels (sides 12, 12, cross members 12", for example) having significant lead-in to "self-align" upon assembly. Lateral stability can be critical and is obtained by closely locating tabs on adjoining panels to essentially lock them together to prevent lateral "racking" of the top panels. As noted before, the tops typically are built in multiple panels in order to make weight reasonable for a child to assemble.

Figure 19:
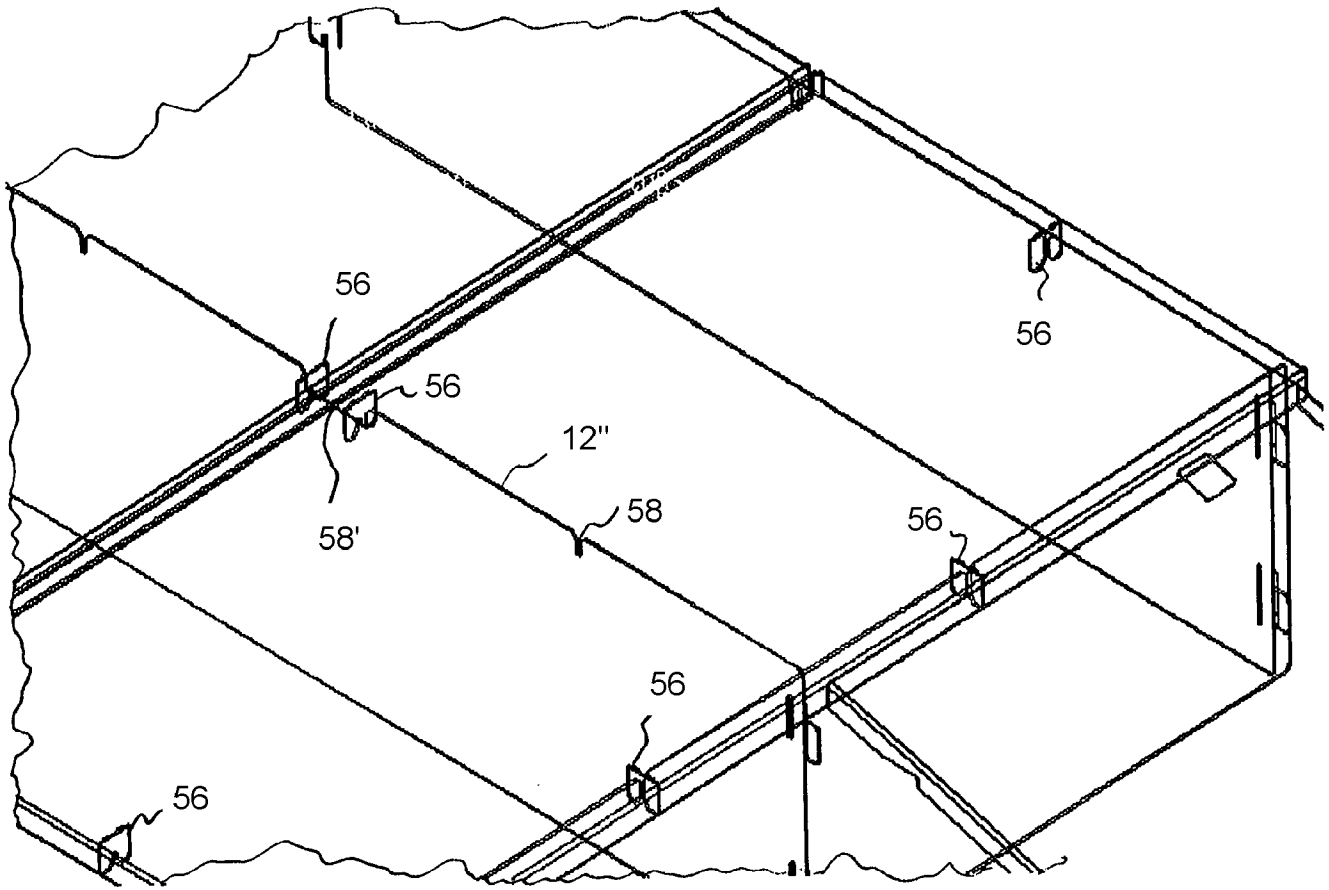
FIG. 19 is a wire frame view that illustrates lateral stability is obtained by closely locating tabs on adjoining panels to essentially lock them together to prevent lateral "racking" of the top panels.

FIG. 19 is a wire frame view that illustrates lateral stability is obtained by closely locating tabs on adjoining panels to essentially lock them together to prevent lateral "racking" of the top panels. Note also that the central cross member 12" may include a substantially wider notch or slot portion 58' to accommodate tab members from the two top portions.

Figures 20, 21:
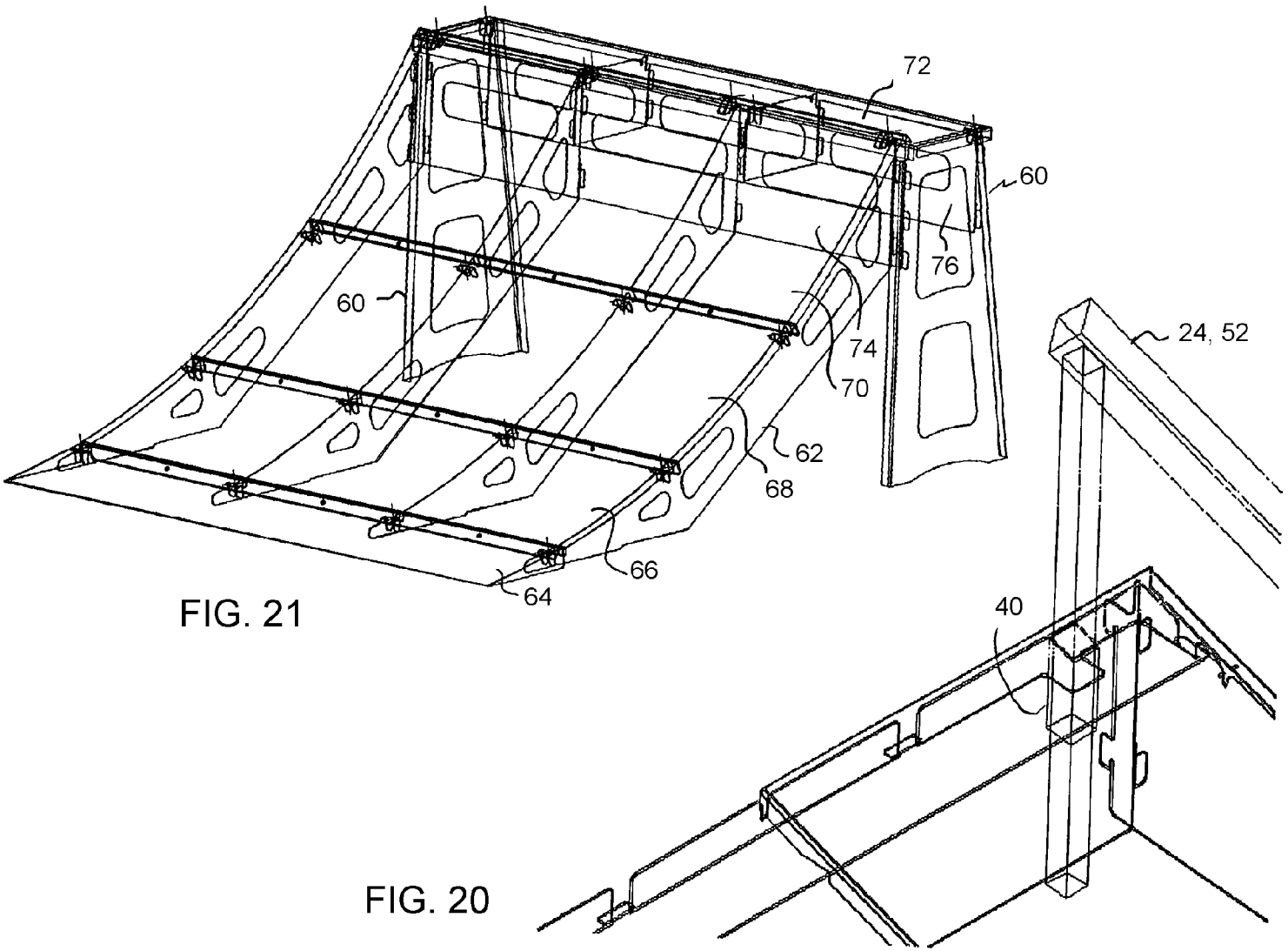
FIG. 20 is a wire frame view that illustrates putting a grindrail into square tube pockets in the ramp or box to allow the rail adequate stability without having to be anchored by other means to a concrete or asphalt surface.
FIG. 21 is a wire frame view of a quarter pipe constructed in accordance with the present invention.

FIG. 20 is a wire frame view that illustrates putting a grindrail into square tube pockets 40 in the ramp or box to allow the rail adequate stability without having to be anchored by other means to a concrete or asphalt surface where the ramp is being set up. The grindrail plugs in without requiring any fasteners. In use, the grindrail can be plugged into either side of the ramp for left-hand or right-hand use.

Note also that as discussed hereinabove, the grindrail square tube pockets have plugs which can be used to cover the openings when the grind rail is not being used.

The grindrail suitably may have a variety of forms, such as a straight rail as shown or, for example, with kinks at either end.

FIG. 21 is a wire frame view of a quarter pipe constructed in accordance with the present invention, comprising end stands 60, four curved ramp braces 62, ramp plates 64, 66, 68 and 70, and ramp top 72. Front and rear upper cross braces 74, 76 are also provided. The front and rear cross braces engage the end stands 60, by use of the hook member/engagement slot configuration as employed with the fun box although in this case, with three hooks and slots at either end of the cross braces for greater lateral strength. The upper ends of the ramp braces connect with the front cross brace, again by use of hook members and corresponding engagement slots. Each of the ramp plates interact with corresponding slots or notches in the ramp braces, by use of tabs on the ramp plates, corresponding to alignment tabs 56 as discussed hereinabove.

Edges of the various top members herein in the illustrated embodiments are flanged to create the required top sheet rigidity. Holes or slots are used in the top panels for manufacturing to accurately locate alignment tabs for welding, spot welding or other fixation.

The ramp system is suitably constructed by using punched, cut, or laser cut steel or other metal sheets, enabling close tolerances to be held on mating features so that tremendous stability and rigidity is achieved.

Complex shapes can be built up beyond what is shown in the exemplary embodiments from the interlocking features described-hooks and slots for vertical panels, and alignment tabs with mating slots for top panels.

While the examples herein illustrate the system as used for skateboarding, the system can also be used for those that in-line skate or use stunt bikes on skate park like obstacles.

The system according to the invention provides advantages over the prior art in that it will knockdown to flat for easy storage in a home driveway use environment, store, trade fair, or school. Each piece is light enough to be managed by one person/child for unaided assembly. The system can be broken down into manageable weight to allow for easy shipment. No tools are required for assembly and no screw connections are required to obtain required rigidity. This is particularly important for children to assemble the device. Further, the device removes the worry about incorrect or incomplete assembly.

Fast set-up and disassembly make home use practical. It can be disassembled and put away rapidly so driveway can be used, or for storage, etc. All top edges are suitably radiused to allow skateboards to slide along the edges. Also radii provide a degree of safety by eliminating sharp sheet metal edges.

The ramp is self-supporting and may be used independently of the "Fun Box" or interlocked together in a variety of positions to use as a unit.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A skate, bike or skateboard park system, adapted for assembly or disassembly and use substantially in absence of external fasteners or tools, comprising:

at least first and second substantially flat side members;

wherein one of said side members includes at least one alignment tab member defined at an end thereof, and wherein the other of said side members has at least one corresponding alignment tab receiving portion defined therein, for removably receiving said alignment tab therein so as to, when said alignment tab and said alignment tab receiving portions are engaged, define a skateboard park system element, wherein said at least first and second side members form a base portion, and further comprising:

a top member adapted to cooperate with said base portion to form an obstacle member, wherein said top member comprises at least 2 separate top portions so as to provide a top of a desired size while minimizing the weight of any individual portion.

2. A skate, bike or skateboard park system, adapted for assembly or disassembly and use substantially in absence of external fasteners or tools, comprising:

at least first and second substantially flat side members;

wherein one of said side members includes at least one alignment tab member defined at an end thereof, and wherein the other of said side members has at least one corresponding alignment tab receiving portion defined therein, for removably receiving said alignment tab therein so as to, when said alignment tab and said alignment tab receiving portions are engaged, define a skateboard park system element, wherein said at least first and second side members form a base portion, and further comprising:

a top member adapted to cooperate with said base portion to form an obstacle member, wherein said top member and said base portion are provided with cooperatively interacting members to as to cooperate and provide a rigid engagement therebetween.

3. A skate, bike or skateboard park system according to claim 2, wherein said cooperatively interacting members comprise at least one tab member and a corresponding slot portion for receiving said tab member therein.

4. A skate, bike or skateboard park system according to claim 2, wherein said cooperatively interacting members comprise at least one male member and a corresponding female portion adapted to receive said male member.

5. A skate, bike or skateboard park system according to claim 4, wherein said at least one male member comprises an alignment tab with a slot therein and said corresponding female portion comprises a recessed portion defined in said base portion and defining a shoulder so as to receive said alignment tab thereagainst, with said slot cooperating with said base portion and said shoulder abutting said tab portion to provide the engagement.

6. A method of providing a skate park component for use by skaters, bikers or skateboarders for performing stunts, comprising:

providing plural interlockable sub-pieces of a skate park component adapted for repeated assembly, use, and disassembly in absence of external fasteners, ones of said sub-pieces being provided with outwardly protruding hook members and other ones of said sub-pieces being provided with corresponding mating slots adapted to receive said hook members therein, ones of said outwardly protruding hook members being substantially co-planar with the respective sub-pieces from which said ones of outwardly protruding hook members protrude from;

assembling said plural interlockable sub-pieces to form the skate park component.

7. The method according to claim 6, wherein said assembling is performed to provide a skate park component comprising a ramp.

8. The method according to claim 6, wherein said assembling is performed to provide a skate park component comprising a pipe section.

9. A method of providing a skate park component for use by skaters, bikers or skateboarders for performing stunts, comprising:

providing plural interlockable sub-pieces of a skate park component, ones of said sub-pieces being provided with outwardly protruding hook members and other ones of said sub-pieces being provided with corresponding mating slots adapted to receive said hook members therein, ones of said outwardly protruding hook members being substantially co-planar with the respective sub-pieces from which said ones of outwardly protruding hook members protrude from;

assembling said plural interlockable sub-pieces by insertion of ones of said protruding hook members into corresponding other ones of said mating slots to form the skate park component, wherein said method is performed by a person substantially in absence of use of tools.

10. A method of providing a skate park component for use by skaters, bikers or skateboarders for performing stunts, comprising:

providing plural interlockable sub-pieces of a skate park component;

assembling said plural interlockable sub-pieces to form the skate park component, wherein said assembling is performed substantially in absence of use of fasteners other than integral portions of said sub-pieces, said integral portions comprising, outwardly protruding hook members defined on ones of said sub-pieces and corresponding mating slots adapted to receive said hook members therein defined in other ones of said sub-pieces, ones of said outwardly protruding hook members being substantially co-planar with the respective sub-pieces from which said ones of outwardly protruding hook members protrude from.

11. A method of providing a skate park component for use by skaters, bikers or skateboarders for performing stunts, comprising:

providing plural interlockable sub-pieces of a skate park component;

assembling said plural interlockable sub-pieces to form the skate park component, wherein said said assembling is performed to provide a skate park component comprising a fun box.

12. A method of providing a skate park component for use by skaters, bikers or skateboarders for performing stunts, comprising:

providing plural interlockable sub-pieces of a skate park component base assembly;

assembling said plural interlockable sub-pieces to form the skate park component base assembly, further comprising providing said skate park component base assembly with receiving portions to removably receive a grind rail attachment by engagement of a portion of said grind rail attachment with said receiving portions, thereby providing a skate park component adapted to be readily dis-assembled, moved and re-assembled in an alternate location substantially in absence of use of permanent anchor portions.

13. A method of providing a skate park component for use by skaters, bikers or skateboarders for performing stunts, comprising:

providing plural interlockable sub-pieces of a skate park component;

assembling said plural interlockable sub-pieces to form the skate park component, wherein ones of said sub-pieces are provided with engaging members comprising hook members and others of said sub-pieces are provided with corresponding engaged portions comprising mating receivers corresponding to said hook members, whereby engaging said engaging members with said engaged portions interlocks said pieces, said hook members being substantially co-planar with the respective sub-pieces on which said hook members are provided.

14. A skate, bike or skateboard park system, comprising:

a skate obstacle and adapted to enable a skater, a biker or a skateboarder to skate, bike or skateboard thereon; and a grindrail;

wherein said skate obstacle comprises a grindrail receiving portion defined therein for removably receiving and mounting said grindrail therein, wherein said skate obstacle comprises a fun box, said skate obstacle being adapted to be readily dis-assembled, moved and re-assembled in an alternate location substantially in absence of use of permanent anchor portions relative to a ground.

15. A skate, bike or skateboard park system, comprising:

a skate obstacle and adapted to enable a skater, a biker or a skateboarder to skate, bike or skateboard thereon; and a grindrail;

wherein said skate obstacle comprises a grindrail receiving portion defined therein for removably receiving and mounting said grindrail therein, wherein said grindrail and grindrail receiving portion interact to enable attachment or removal of said grindrail to said obstacle substantially in absence of use of additional fasteners, said skate obstacle being adapted to be readily dis-assembled, moved and re-assembled in an alternate location substantially in absence of use of permanent anchor portions relative to a ground.

16. A skate, bike or skateboard park system, comprising:

a skate obstacle and adapted to enable a skater, a biker or a skateboarder to skate, bike or skateboard thereon; and a grindrail;

wherein said skate obstacle comprises a grindrail receiving portion defined therein for removably receiving and mounting said grindrail therein, wherein said grindrail comprises at least one insertion member having a cross sectional shape and wherein said grindrail receiving portion comprises a corresponding pocket with a complementary cross sectional shape to the insertion member cross sectional shape, so as to receive the insertion member, said skate obstacle being adapted to be readily dis-assembled, moved and re-assembled in an alternate location substantially in absence of use of permanent anchor portions relative to a ground.

17. A skate, bike or skateboard park system, comprising:

a skate obstacle and adapted to enable a skater, a biker or a skateboarder to skate, bike or skateboard thereon; and a grindrail;

wherein said skate obstacle comprises a grindrail receiving portion defined therein for removably receiving and mounting said grindrail therein, further comprising a second skate obstacle, wherein said first mentioned skate obstacle and said second obstacle cooperatively engage so as to define a combined skate obstacle, said first and second skate obstacles being adapted to be readily dis-assembled, moved and re-assembled in an alternate location substantially in absence of use of permanent anchor portions relative to a ground.

18. A skate, bike or skateboard park system according to claim 17, wherein said first skate obstacle and said second skate obstacle are selected from the group consisting of a fun box, a ramp member and a pipe section.

* * * * *